United States Patent [19]

Humphries

[11] 4,304,352

[45] Dec. 8, 1981

[54] FLANGED TRAY WITH GUSSET CORNERS

[75] Inventor: Richard L. Humphries, Sunnyvale, Calif.

[73] Assignee: Kliklok Corporation, Greenwich, Conn.

[21] Appl. No.: 134,991

[22] Filed: Mar. 28, 1980

[51] Int. Cl.[3] ..... B65D 5/24; B65D 5/22

[52] U.S. Cl. ..... 229/31 R; 229/26

[58] Field of Search ..... 229/31, 24, 25, 26

[56] References Cited

U.S. PATENT DOCUMENTS

| | | | |
|---|---|---|---|
| 717,775 | 1/1903 | Single | 229/26 |
| 1,959,613 | 5/1934 | Carson | 229/31 R |
| 2,071,949 | 2/1937 | Reich | 229/31 R |
| 2,823,847 | 2/1958 | Barnes et al. | 229/31 R |
| 2,846,132 | 8/1958 | Carpenter | 229/31 R |
| 3,054,550 | 9/1962 | Comstock | 229/31 R |
| 3,386,644 | 6/1968 | Zackheim | 229/41 R |
| 3,917,155 | 11/1975 | Bemiss | 229/31 R |
| 4,114,797 | 9/1978 | Manizza | 229/31 R |

*Primary Examiner*—Davis T. Moorhead

*Attorney, Agent, or Firm*—Lowe, King, Price & Becker

[57] ABSTRACT

A tray having side wals and a bottom wall is provided with leakproof gusset corners including overlapping gusset panels connected by a center fold line. Side fiold lines connect the respective gusset panels to the side walls with sealing portions of the gusset panels extending the full depth of the side walls for full depth leakproofness of the tray. A cut-out in the inner gusset panel allows bonding of the outer gusset panel against the side wall strengthening the corner of the tray and assuring the sealing action. The cut-out in the inner gusset panel is particularly shaped to form the sealing portion and to allow maximum bonding of the outer gusset panel. A peripheral flange is formed of flange sections having alternate extensions with abutting edges to provide an equal width flange around each corner and the full periphery of the tray. During folding, the flange extension cooperates with a rounded corner of the sealing portion of the inner gusset panel to assure smooth and efficient folding action.

6 Claims, 5 Drawing Figures

FLANGED TRAY WITH GUSSET CORNERS

FIELD OF THE INVENTION

The present invention relates to containers that are adapted for machine forming; and more particularly, to easily formed paperboard flanged trays with more efficient gusset corners.

BACKGROUND OF THE INVENTION

Coated paperboard trays for serving food, particularly packaged convenience food, are becoming more and more popular. With the advent of the microwave oven, the trend in the industry toward paperboard trays has accelerated, since as is well known, aluminum containers cannot be effectively used in the microwave ovens. With the development of polyester coatings for the tray, the same tray can also be placed in a conventional radiant heat oven without adverse effects.

This food serving tray has not only become very popular for home use, but also where large volumes of food must be cooked and used within a short period of time, such as in the airline industry and in hospitals. The food prepared and placed in the coated paperboard trays can be frozen and then quickly reheated, generally in a microwave oven, for serving. Since the serving trays are disposable, the washing of dishes is eliminated.

In the field of packaging convenience foods, Kliklok Corporation, the assignee of the present invention, is the leader. This company is the assignee of the prior patent application entitled "Method and Apparatus for Forming a Flanged Tray," Baker et al., Ser. No. 55,050, filed July 6, 1979. In this application, a highly efficient tray forming method and machine is shown and claimed. In the application, a standard flanged ovenable tray is disclosed that is successful in this field.

The Kliklok prior art ovenable tray is coated with the polyester resin film. The tray is extremely strong including reinforced corners in order to prevent collapse of the tray when filled and during stacking and handling. The flange around the top of the tray also reinforces the tray, and in addition provides a convenient way of applying a simple lid to the tray. The lid is particularly useful in instances where foods are to be cooked while sealed in order to retain moisture and the flavor of the food.

While the tray of the prior art has thus been successful, and is capable of storing many different kinds of food, there has been identified a need for a tray with reinforced corners that is leakproof substantialy to the very top of the tray. In the past, when forming the reinforced corner on a high-speed packaging machine such as shown in the prior Baker et al. application '050, the leakproof characteristic could be extended only up a portion of the side of the tray. It can be seen that while this prior art arrangement was suitable for some products, such as bakery products where no liquid is involved in the packing, such trays were not suitable for liquid or semi-liquid products, which represent a large proportion of the packaged foods.

Accordingly, it is an object of the present invention to provide an improved tray having reinforced corners which are leakproof, and which tray can be formed on high-speed machinery.

It is another object of the present invention to provide a tray formed of ovenable paperboard suitable for use in conventional and microwave ovens having reinforced corners and a reinforcing flange around the top of the tray.

It is still another object of the present invention to provide a gusset corner for a tray wherein the corner may be easily formed on existing machines and provides reinforcement and full-depth leakproofness to the tray.

It is still another object of the present invention to provide a flanged, ovenable tray and gusset corner therefor wherein the gusset structure is firmly and securely held against the adjacent side wall of the tray for reinforcement of the corner and for sealing along the full depth of the side wall.

SUMMARY OF THE INVENTION

These objectives and equally important objectives are obtained by the present invention by providing a tray having gusset corners with sealing portions on the two gusset panels extending the full depth of the side walls of the panels. Specifically, the tray includes at each corner adjacent side walls and a bottom wall with a pair of gusset panels connected by a center fold line extending from a point of intersection between the side walls and the bottom wall. The side fold lines also extend upwardly from this point and when the gusset panel is folded an inner and outer gusset is defined. According to the invention, a cut-out is provided in the inner gusset panel extending from the center fold line to the sealing portion of the inner gusset panel adjacent the corresponding side fold line. The outer gusset panel opposite the cut-out when folded extends through the cut-out for bonding to the facing side wall. The bond area between the outer gusset panel and the facing side wall is defined by the cut-out.

With this structure, the gusset corner is securely held against the facing side wall for reinforcement of the corner and sealing along the full depth of the side wall. This means that the tray is not only enhanced in strength over the prior art tray, but is also usable with any product, including liquid and semi-liquid products. When a flat lid is provided with the tray, such products as soup and meat dishes packed in their natural juices, and filling substantially to the top of the tray, can be successfully packaged in this manner. Because the gusset panels adjacent the side fold lines are provided with full depth sealing portions, there is no pin-hole escape route provided for the liquids. Once the folded gusset is securely attached to the side wall of the container, with the sealing portions of the gusset panels securely held together, the tray is rendered fully leakproof.

The cut-out in the inner gusset panel is defined by an opening at the top thereof. A first side of the opening is defined by the upper part of the center fold line, and a second side extends at an angle toward the top of the corresponding side fold line. The sealing portion of the inner gusset panel is defined between the side fold line and the upper part of the second side of the opening. The second side of the opening also includes an upwardly directed open angle at a midpoint so that the bond area is enlarged to provide maximum strength.

A peripheral flange is provided around the top of the side walls with the flange sections abutting to form a single layer flange whereby a lid may be sealed flat over the container. One flange section of each pair includes an extension so that the flange extends around the full corner and around the full periphery of the tray. The inner gusset panel is adapted for smooth folding action and no interference with the flange by a curve being formed at the top of the panel where the sealing portion meets the top of the side wall.

BRIEF DESCRIPTION OF THE DRAWING

These and other objectives, features and advantages of the present invention are presented in the following detailed description of the preferred embodiment and illustrated in the accompanying drawing figures wherein.

DESCRIPTION OF THE PREFERRED EMBODIMENT

Figure 1:
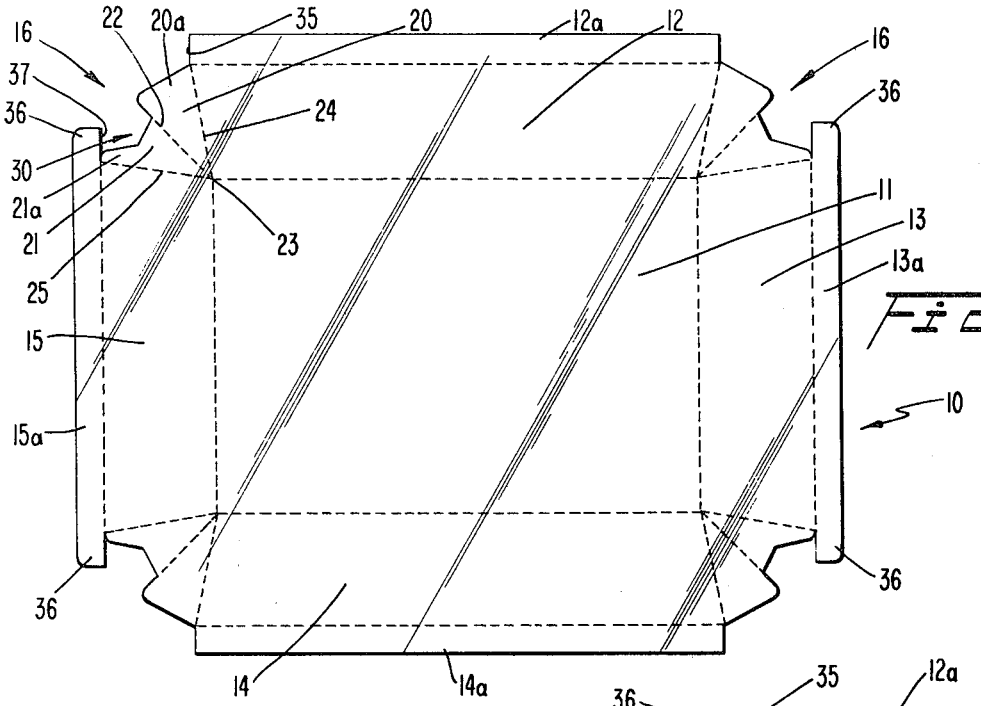
FIG. 1 is a plan view of a paperboard blank for forming a flanged tray with full depth sealing gusset corners in accordance with the present invention.

With reference now to FIG. 1 of the drawings, the present preferred embodiment of the invention can be described in more complete detail. Thus, a tray blank 10 is illustrated in its open configuration with a bottom wall 11 and four side walls 12, 13, 14 and 15. Interconnecting each of the adjacent side walls 12–15 is a gusset corner, generally designated by the reference numeral 16. Attached along an outer fold line to each of the side walls 12–15 are corresponding flange sections **12*a*, 13*a*, 14*a* and 15*a***.

In FIGS. 2–5, the sequential steps of folding and erecting the preferred embodiment of the tray blank 10 can be easily seen. One gusset corner 16 of a tray T, corresponding to the corner shown in the upper left-hand corner of FIG. 1 will be described in detail, it being understood that each of the other three corners is identical. In order to provide the clearest view of the structure and the method of forming, the corner 16 is shown from below in these figures.

As set forth above, an important consideration of the structure of the tray T constructed in accordance with the present invention is that it should be adapted for rapid erection on existing forming machines, and particularly on the Baker et al. forming machine disclosed in the prior application, Ser. No. 55,050. In such a machine, the initial forming action is shown by the force arrows $F_1$, $F_2$ in FIG. 2 wherein the side walls 12, 15, flanges **12*a*, 15*a* and corner 16** are beginning to be folded along their fold lines and the carton erected.

The gusset corner 16 of the present invention includes an outer gusset panel 20 and an inner gusset panel 21. As the designations indicate, the outer panel 20 is on the outside when the tray is fully erected with the inner panel 21 being tucked underneath and lying immediately adjacent the facing side wall 15. The gusset panels 20, 21 are connected by a center fold line 22, thus forming the gusset panels 20, 21 in a generally triangular shape. The center fold line 22 extends outwardly and upwardly from intersection point 23 of the bottom wall 11 and adjacent side walls 12, 15. Extending from the same intersection point 23 are a pair of side fold lines 24, 25 to connect the panels 20, 21 to the adjacent side walls 12, 15, respectively.

It is important to the concept of the present invention that both the side fold lines 24, 25 extend the full depth of the side walls 12, 15. This feature provides for full depth sealing portions of both of the gusset panels 20, 21. Thus, when the tray T is fully erected, the gusset corners 16 are fully leakproof, as will be seen in fuller detail below.

Figure 2:
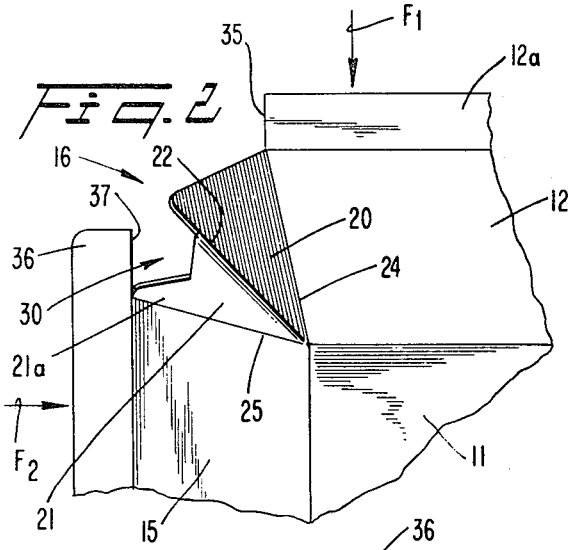
FIG. 2 is a bottom plan view of one of the corners of the tray showing the corner being folded during erection of the tray.

Viewing FIGS. 1 and 2 together, a cut-out, generally designated by the reference numeral 30 is shown in the inner gusset panel 21. As shown, this cut-out 30 is at the top of the panel 21 and extends from the center fold line over to narrowed sealing portion **21*a* of said panel 21. Because of this cut-out the top portion or member 20*a* of the outer gusset panel 20 can extend through the inner gusset panel 21 and be attached directly to the facing side wall 15 (see FIG. 5). The attachment or bonding of the top portion 20*a* to the side wall 15 holds the gusset corner 16 in position thereby not only sealing the corner but providing substantial reinforcement to the corner and thereby enhancing the strength of the entire tray. The strength of the tray is not only increased in terms of resisting pressure from inside that might otherwise cause the tray to open, but also increases the strength of the tray with respect to outside compressive forces acting across the depth of the tray, such as would occur during stacking of several filled trays in a shipping container. As will be realized, the cut-out 30 generally defines the bond area between the inner face of the outer gusset panel 20 and the outer face of the side wall 15, or in other words, the bond area comprises the area immediately underneath the top portion 20*a***.

In accordance with the preferred embodiment shown, the cut-out 30 comprises an opening of a particular shape; namely, a first side extending substantially along the center line 22 (see FIGS. 1 and 2), and a second side extending from the base of the first side of the opening to the top of the corresponding side fold line 25. The top end of the second side is curved or rounded along a radius. This provides for the full depth seal of the sealing portion **21*a*, but at the same time, the rounded corner assures that during machine erection the gusset panel 21 slides smoothly beneath the adjacent flange section 15*a*. This is particularly important where the flange sections 12*a*, 15*a*** are overbent and held in the forming apparatus in accordance with the method set forth in the co-pending application of Baker et al., Ser. No. 55,050, mentioned above. Furthermore, the second side of the opening is also provided with an upwardly opening angle at the midpoint so that the bond area is enlarged over what it would be if a straight line was taken from the base of the first side of the opening to the curved top end.

Figure 3:
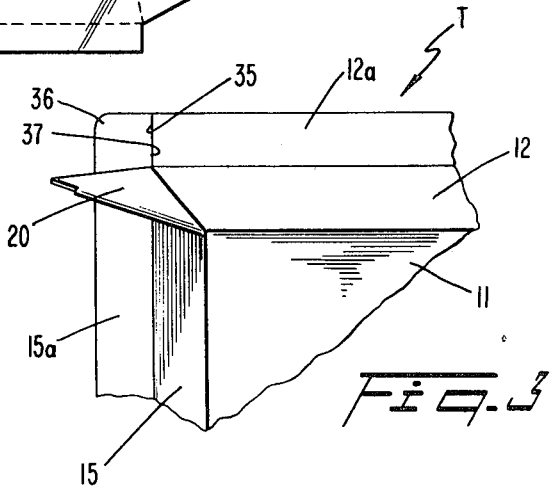
FIG. 3 is a bottom view of the same corner with the corner in the full erected position but with the overlapped gusset panels unattached.
Figure 4:
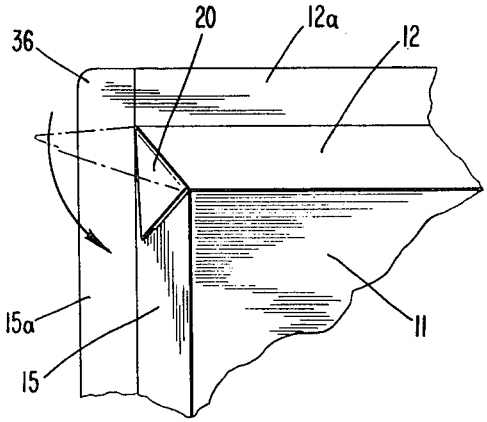
FIG. 4 is a bottom view of the same corner with the overlapped gusset panels folded into the final position for bonding to the side wall.
Figure 5:
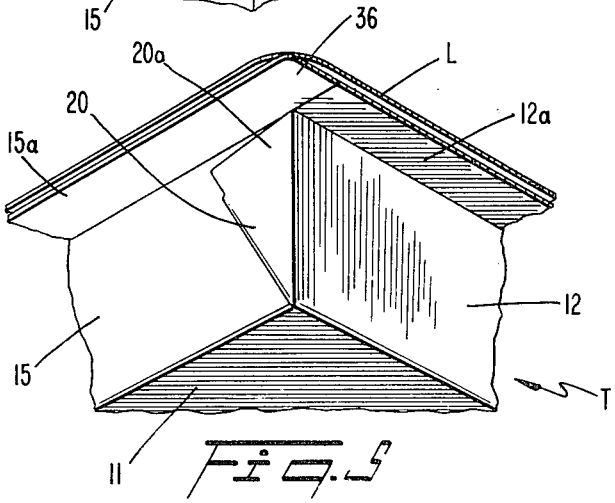
FIG. 5 is a perspective view of the same corner looking in from the bottom of the container showing the overlapped gusset panels sealed against the side wall completing the corner and with a lid sealed to the top flange of the container to close the container.

The two opposed flange sections **12*a*, 14*a* that extend from the top of the side walls 12, 14, respectively, when the tray is erected, terminate adjacent the upper end of the side fold line 24. Thus, flange section 12*a* includes edge 35 (see FIGS. 1 and 2). The opposite side walls 13, 15 are provided with the similar flange sections 13*a*, 15*a*, respectively, that are designed through extensions 36 to cooperate with the corresponding edges on the adjacent flange sections 12*a*, 14*a* to form a full peripheral flange. The extension 36 is thus provided with abutting lateral edge 37 designed to mate with the adjacent edge 35 (FIG. 3). Because the two edges match, a peripheral flange that is flat is provided so that a lid L, as shown in FIG. 5** may be placed on the container and efficiently sealed. With no overlapping of the adjacent flanges, the possibility of a pin-hole opening formed between these overlapping flanges is eliminated.

In view of the foregoing, it is believed evident that the tray of the present invention having the improved gusset corner 16 provides highly-desirable results. The gusset panels 20, 21 are provided with full depth sealing portions along the side walls 12, 15 so that the full interior volume of the container is leakproof. The cut-out 30 provides for efficient bonding of the outer gusset panel 20 to the side wall 15. This provides a structurally strengthened corner, as well as assuring the sealing action along the overlapping sealing portions of the gusset panels 20, 21. The cut-out 30 is of a particular geometric configuration, to enhance the bonding, and thus strengthening action as well as to allow easy machine forming and folding of the adjacent flange sections 12*a*, 15*a*. The abutting edges 35, 37 provide for the efficient sealing of the lid L on the tray T without overlapping flanges that can provide pin-hole leakage.

The present invention is not limited to the specific details shown and described, and modifications may be made without departing from the principles of the invention.

I claim:

1. A tray having gusset corners for forming a leakproof container for packaging food or the like comprising:

adjacent side walls and a bottom wall of said tray;

a pair of gusset panels connected by a center fold line extending from adjacent a point of intersection between said side walls and said bottom wall;

a pair of side fold lines extending from adjacent said point connecting the respective gusset panel to the adjacent side wall;

both side fold lines and the adjacent sealing portions of the gusset panels extending the full depth of said side wall;

a cut-out in the inner gusset panel when folded for erection, said cut-out extending from said center fold line to said sealing portion of said inner gusset panel;

the sealing portion of said inner gusset panel being a narrowed member defined by the adjacent side fold line and the adjacent edge of said cut-out, the outer gusset panel opposite said cut-out when folded for erection extending through said cut-out for bonding to the facing side wall;

a bond area between said outer gusset panel and the facing said wall defined by said cut-out, whereby said gusset corner is securely held against said facing side wall for reinforcement of the corner sealing along the full depth of said side wall.

2. The tray having gusset corners of claim 1 wherein said cut-out is defined by an opening at the top of said inner gusset panel, a first side of the opening extending substantially along said center fold line, and a second side of said opening extending from the base of said first side to the top of the corresponding side fold line of said inner gusset panel, the sealing portion of said inner gusset panel being formed between the second side of the opening and the side fold line.

3. The tray having gusset corners of claim 2 wherein is further provided a peripheral flange including individual flange sections extending substantially horizontally from the top of said side walls when the corners are erected, the edges of said flange sections abutting to form a single layer, whereby a lid may be sealed flat over said container.

4. The tray having gusset corners of claim 3 wherein one of each pair of said flange sections includes an extension extending across the width of the adjacent flange adjacent the abutting edges whereby an equal width flange is provided around each full corner and the periphery of the tray.

5. The tray having gusset corners of claim 3 wherein the top of said second side of the opening is curved upwardly to the top of said side fold line, whereby said sealing portion provides a full-depth seal and may be smoothly guided beneath the adjacent flange section.

6. The tray having gusset corners of claim 2 wherein said second side of said opening is provided with an upwardly directed angle at a mid-point along said side, whereby the bond area is enlarged.

* * * * *